US005316200A

United States Patent [19]

Wallin

[11] Patent Number: 5,316,200

[45] Date of Patent: May 31, 1994

[54] AUTOMATIC NAILING HEAD

[76] Inventor: Roger W. Wallin, 23042 Nightingale St., St. Francis, Minn. 55070

[21] Appl. No.: 22,682

[22] Filed: Mar. 1, 1993

[51] Int. Cl.[5] ..... B27F 7/02

[52] U.S. Cl. ..... 227/119; 227/45; 227/135

[58] Field of Search ..... 227/119, 135, 45, 101

[56] References Cited

U.S. PATENT DOCUMENTS

| | | | |
|---|---|---|---|
| 2,456,221 | 12/1948 | Stilwell et al. | 227/45 |
| 3,061,147 | 10/1962 | Vilmerding | 227/119 |
| 3,138,810 | 6/1964 | Becker | 227/119 |
| 3,207,403 | 9/1965 | Stoddard et al. | 227/101 |
| 3,945,549 | 3/1976 | Colson | 227/45 |
| 4,609,134 | 9/1986 | Davern | 227/119 |
| 5,199,506 | 4/1993 | Dewey et al. | 227/119 |

*Primary Examiner*—Scott Smith

[57] ABSTRACT

An automatic nailing head for an automatic nailing device is disclosed. A nailing head including a means for causing an angle between a central shank axis of the nail and a central axis of the throughbore to gradually decrease as the nail passes through a nail feed channel and into the throughbore is described. A picker plate capable of receiving a nail when in a first position and dropping the picked nail when moved to a second position is described. A nailing head with a quick release body portion for unjamming the heads without the use of tools is also described.

4 Claims, 7 Drawing Sheets

Fig. 7
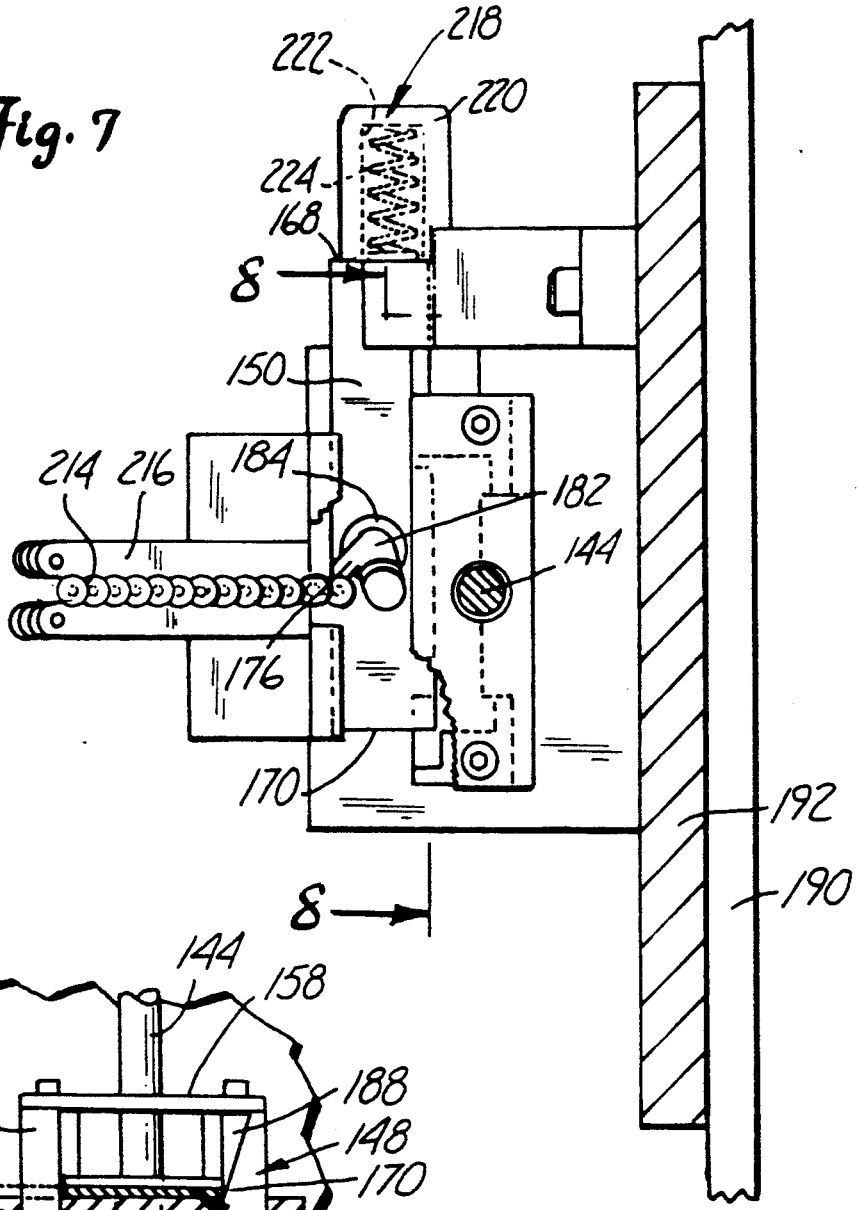
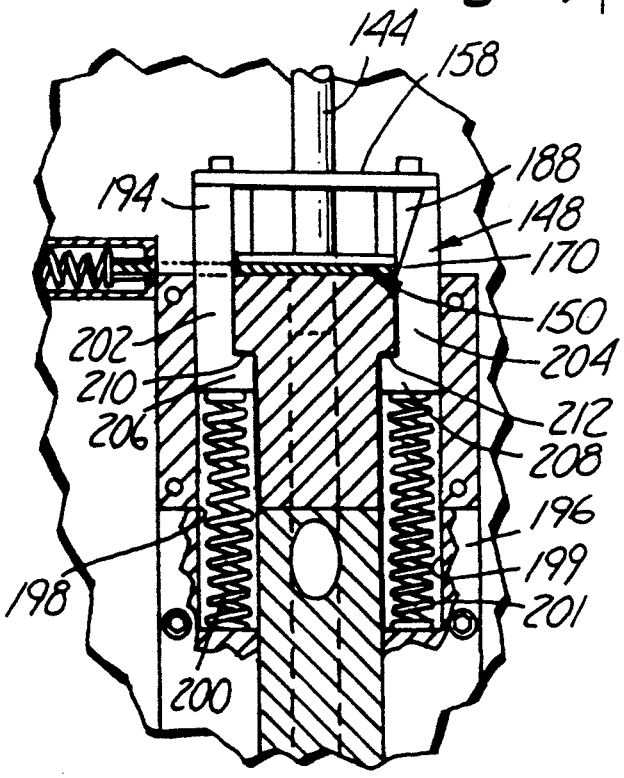
Fig. 8

AUTOMATIC NAILING HEAD

BACKGROUND OF THE INVENTION

The present invention relates generally to automatic nailing devices and more particularly to a nailing head assembly for an automatic nailing device.

Automatic nailing devices, such as the device disclosed in the Colson U.S. Pat. No. 3,945,549, are known in the art. These devices advantageously replace manual labor in certain repetitive manufacturing operations such as in the manufacture of pallets and wooden fencing, for example. However, the automatic nailing unit disclosed in the Colson patent has several features that limit its capacity.

The automatic nailing device of Colson forms stringer pallets and is shown in FIG. 1. The device 20 includes a frame 22 supported by a pair of vertical support legs 24 at a feed end 26, and a pair of vertical support legs 28 at a discharge end 30.

Mounted to the frame 22 is a feed conveyor 32. Although only one side of the conveyor 32 is shown in FIG. 1, the opposite side is identical, except that the opposite side is a mirror image of the side shown. Only the side shown will be described for purposes of clarity.

The conveyor 32 includes a pair of spaced apart endless chains 34, mounted on sprockets 36, 38 and 40. The sprockets are mounted onto shafts (not shown) mounted for rotation in the frame by means known in the art. A drive motor (not shown) is provided to cause the chains to move along an endless path. A plurality of drive bars (not shown) are attached at each end to the chains, and are positioned transverse to a machine direction shown by arrow 42.

A flat plate 44 is mounted to an upper surface of the frame 22 and supports a plurality of stringer magazines 46 mounted above the plate 44. Each magazine 46 drops a stringer positioned in the machine direction 42 onto the drive bars (not shown). The drive bars advance a group of stringers in the machine direction 42 in response to instructions from a controller (not shown).

A plank magazine 48 is positioned to deposit planks in a direction transverse to the machine direction 42 and onto an upper surface of each stringer. The spacing between planks and the number of planks placed on the stringers is determined by the controller (not shown).

Next, the assembly of stringers and planks is moved under a nailing station 50. The nailing station 50 includes an upright frame 52 which supports a plurality of nailing units 54. The upright frame 52 is adjustable in height to accommodate different pallet thicknesses. One nailing unit 54 is provided for each stringer.

Each nailing unit includes a vertical plate 56 and a pneumatic cylinder 58 mounted vertically to the plate. A piston 60 of each cylinder 58 is positioned on a lower end of the cylinder 58 and is fixedly connected to a driving rod 62 by means of a coupling (not shown) an upper portion of the driving rod 62 includes an enlarged portion 64 for contacting an actuator 65.

Each nailing unit includes a nailing head 66 having a vertical throughbore for accepting the driving rod 62, and a nail feed channel fluidly connected to the vertical throughbore for depositing nails into the nailing head 66. Details of the known nailing head 66 will be described in more detail below.

A vibratory nail feeder 68 is mounted to the frame 22 and is provided for delivering vertically oriented nails to a nail track 70. The nail track delivers nails to the nail delivery channel of the nailing head 66.

A cross-sectional view of the nailing head 66 is shown in FIG. 2. A nail guide track 70 comprising a pair of declining, horizontally spaced bars 72 is positioned to deliver nails to the nailing head 66. The head 66 has a main body portion 74 having a vertically oriented slot 76 extending through a side wall for receiving nails from the guide track 70. The slot 76 defines an opening to a nail feed channel 78 which delivers nails by means of gravity to a vertical throughbore 80. The throughbore 80 is substantially cylindrical and intersects and is fluidly connected to the nail feed channel 78 through an elongated opening 82. The nail drops into the throughbore 80 and continues to fall until a leading edge contacts a pair of jaws 84*a*, 84*b* pivotally mounted to the body portion 74 by means of pivot pins 86*a* and 86*b*. The jaws 84*a*, 84*b* are spring biased by means of opposing leaf springs 88*a* and 88*b*.

A tensioning device 90 is provided to adjust the amount of force delivered to the jaws 84*a*, 84*b* by the leaf springs 88*a*, 88*b*. The tensioning device comprises a housing 92, a spring 94 and an adjustment knob 96 for adjusting the amount of force the spring 94 applies to the leaf springs 88*a*, 88*b*.

A driving rod 62 is driven downwardly by means of a hydraulic ram 60 (shown in FIG. 1) to force a nail which is retained in a lower portion of the throughbore 80 through the spring biased jaws 84*a*, 84*b* and into the materials to be nailed together (not shown) located beneath the jaws 84.

A nail picker plate 98 is mounted for horizontal, reciprocal sliding motion in the nailing head 66. The direction of motion of the picker plate is into and out of the paper. A top elevational view of the picker plate is shown in FIG. 3.

The picker plate has a first major surface 100, an opposite surface 102 (shown in FIG. 2) substantially flat edges 104, 106 and 108, and a cammed edge 110 for contacting a cammed surface on an actuator (not shown). The picker plate has a notch 112 for receiving a nail picked from the nail track 70. The picker plate also has an aperture 114 extending through the first and opposite major surfaces 100 and 102. Connecting the aperture 114 and the notch 112 is a channel 116 which permits the nail in the notch to move to the aperture. The notch is smaller in width than the nail head, and the nail is suspended in the slot 76 of the main body portion when positioned in the notch 112.

An actuator (not shown) causes the picker plate 98 to move in a direction shown by arrow 118 when a lower shoulder (not shown) on an enlarged portion 64 of the nail driving rod 62 contacts an upper surface of the actuator (not shown). A camming surface of the actuator which contacts camming surface 110 causes the picker plate to move in a direction shown by arrow 118 until a leading edge of the notch 112 is aligned with an open end of the nail track 70. The vibration of the nail feeder 68 and nail track 70 causes the nail to travel into the notch 112. This occurs as the driving rod 62 nears the lowest portion of the downstroke. As the driving rod 62 begins moving upwardly, the actuator releases pressure on the camming surface 110 and the picker plate 98 moves in a direction opposite the direction shown by arrow 118. During this portion of the movement, the picked nail moves through the channel, and into the aperture 114. The aperture is larger than the size of the nail head and the nail falls through the aperture into the nail feed channel 78 (shown in FIG. 2).

Referring back to FIG. 2, the nailing head 66 as well as the hydraulic cylinder 58 (shown in FIG. 1) are mounted onto the vertical plate 56. The vertical plate 56 is removably attached to the frame by means of an upper pair of horizontally positioned channel members (not shown) and a lower pair of horizontally positioned channel members 119*a* and 119*b* which are fixedly mounted to the vertical portions of the upright frame 52 (shown in FIG. 1).

The nailing head 66 is formed from a back section 120 having a vertical, cylindrical groove defining part of the inner surface of the throughbore 80. The head also has a lower front portion 122 having a vertically oriented cylindrical groove defining a portion of the throughbore and a portion of the nail feed channel 78. The head also has an upper front portion 124 having an inner throughbore defining a portion of the nail feed channel 78. Although these parts can be disassembled with the use of tools, it is time consuming and difficult to take the nailing head 66 apart to clear the throughbore 80 and nail feed channel 78 of nails plugging the passages. When the nail head is in a central portion of the nailing station, this task becomes particularly difficult, and causes production delays.

A disadvantage of the device shown in the Colson patent is that a nail is not positioned in the notch of the picker plate until the driving rod is nearing the bottom of the downstroke. Because the picker plate is only in a position to pick a nail for a small portion of the nail hammering shaft's stroke, the picker plate does not always receive a nail from the nail guide track 70. The presence of substances such as galvanized coatings on the nails that cause the nails to stick together may aggravate this problem. Accordingly, the operating speed of the known automatic nailing device is limited.

Another disadvantage is that the nails do not have sufficient time to fall from the picker plate to the bottom of the nail driver bore at higher production rates. The descent of the nail is slowed when the nail is making the transition from the nail feed channel to the throughbore, because the nail must change direction abruptly at the intersection of the nail feed channel and the throughbore. Accordingly, the operating speed of the known automatic nailing device is limited.

SUMMARY OF THE INVENTION

The present invention is a nail driving assembly for an automatic nailing machine. The assembly includes a support frame, a hydraulic cylinder mounted vertically on the support frame and a nailing rod mounted to a ram of the hydraulic cylinder for driving a plurality of nails. The device includes a means for controlling the movement of the ram and nailing rod. A nailing head having a main body portion with a vertically extending longitudinal throughbore, a nail feeding channel extending from a side of the nailing head, declining downwardly and intersecting the longitudinal throughbore is provided for delivering nails to a lower portion of the throughbore. A nail picker plate horizontally mounted for sliding engagement above an opening in the feed channel is provided which in a first position captures a nail in an inwardly extending notch. An actuator means for causing the nail picker plate to move from a first to a second position is provided which causes a nail to move from the notch in the picker plate through a channel and into an aperture. The aperture is large enough to permit the nail to drop into the feeding channel and to cause the nail to descend into the longitudinal throughbore for driving. The nailing head also includes a means for retaining the nail within the longitudinal throughbore until the driving rod drives the nail.

The present invention also includes a nail driving assembly including a means for gradually reducing an angle between a central axis of the nail shank and the central axis of the throughbore during the descent of the nail to increase the speed in which the nail drops. This device optionally includes a nail picker plate which retains a nail in a notch when the plate is in the first position, as described above.

The present invention also includes a nail driving assembly including a means for rapidly opening and closing at least a portion of the throughbore and at least a portion of the feed channel. This feature allows the operator to rapidly clear jammed nails from the nailing head which advantageously reduces production delays.

BRIEF DESCRIPTION OF THE DRAWINGS

FIG. 7 is a top plan view of the nailing head of the present invention.

FIG. 8 is a cross-sectional view taken generally along line 7—7 as shown in FIG. 7.

DETAILED DESCRIPTION OF THE PREFERRED EMBODIMENT

The present invention is an improved nailing head for an automated nailing machine such as the device shown in Colson U.S. Pat. No. 3,945,549. Colson U.S. Pat. No. 3,945,549 is herein incorporated by reference. The device of the present invention advantageously can be run at higher operational speeds than known automatic nailing devices, resulting in increased production rates and reduced downtime. The reliability of the nailing head of the present invention is also improved over known nailing heads.

Figure 4:
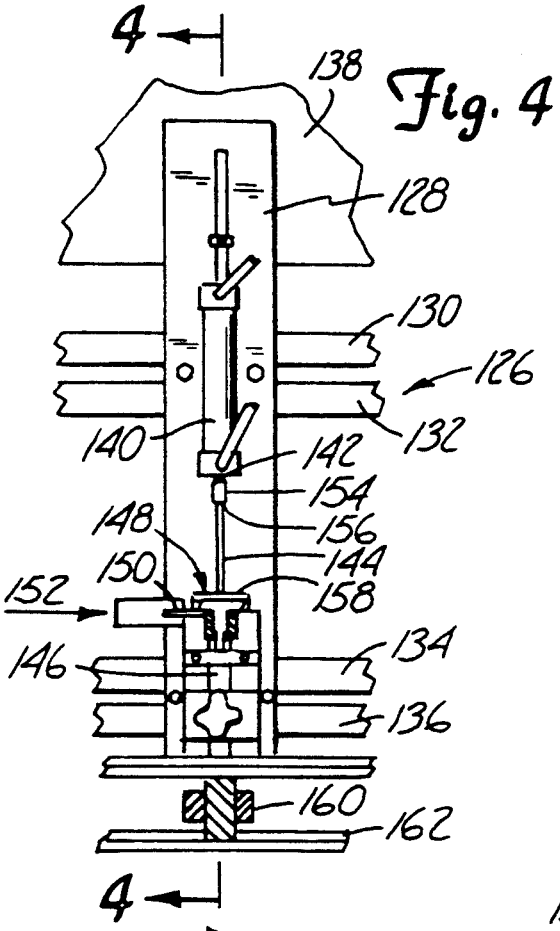
FIG. 4 is a front elevational view of an automatic nailing assembly incorporating a preferred nailing head of the present invention.

The device of the present invention is part of an automatic nailing station shown in FIG. 4.

Figure 1:
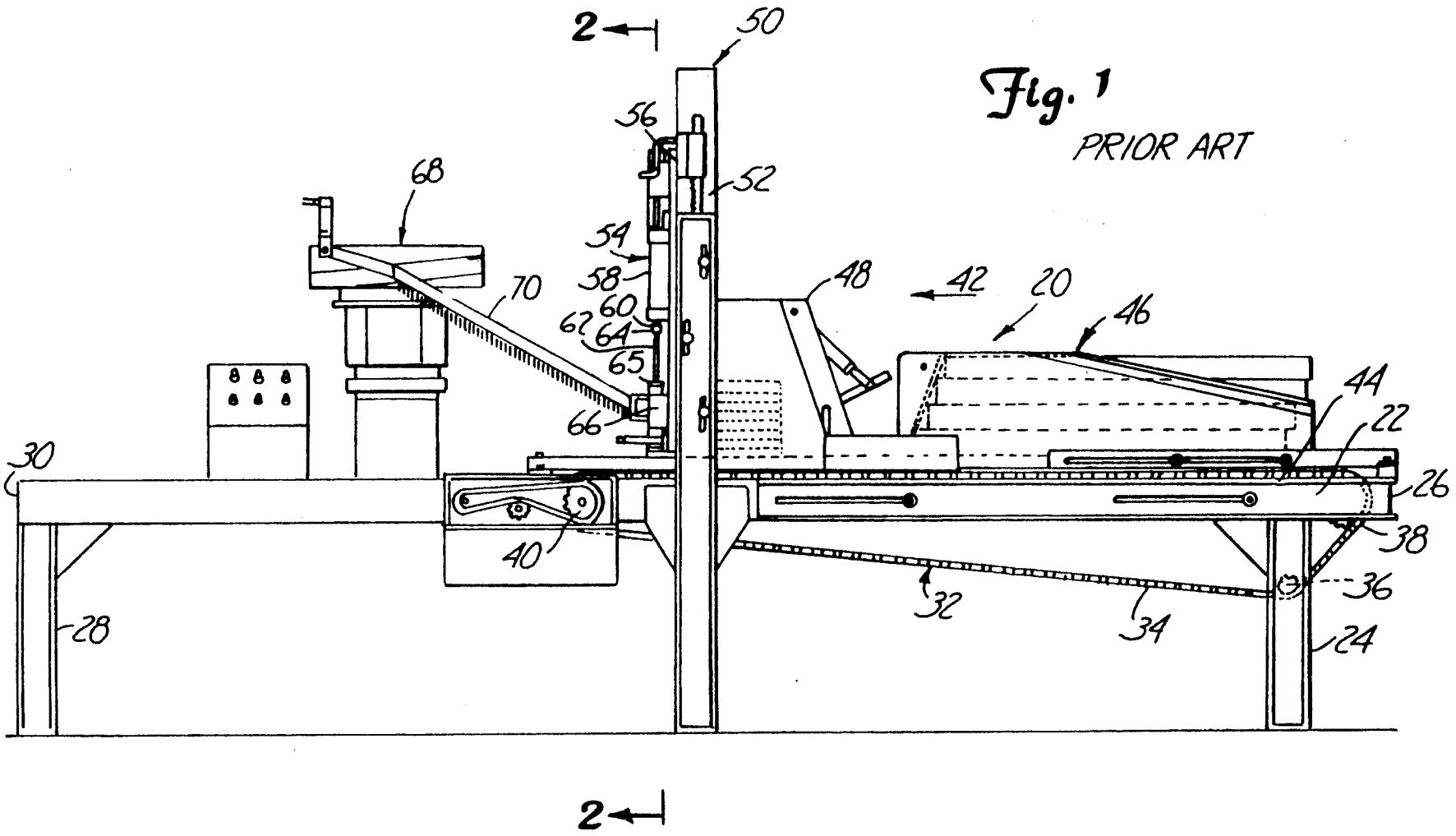
Fig. 1 PRIOR ART
FIG. 1 is a side elevational view of a prior art automated nailing device.
Figure 2:
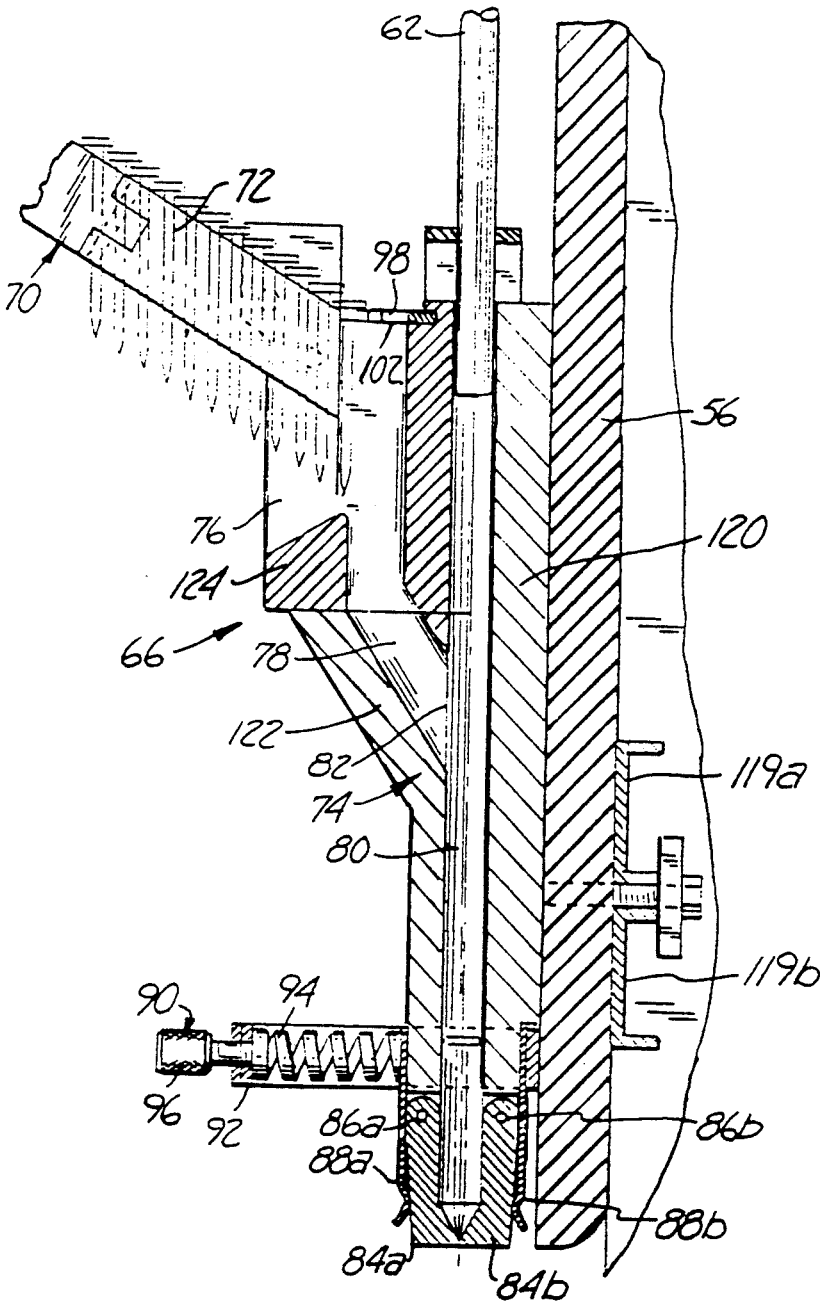
Fig. 2 PRIOR ART
FIG. 2 is an enlarged cross-sectional view of a prior art nailing head, taken along line 2—2 as shown in FIG. 1.

FIG. 4 is a front elevational view of an automatic nailing unit 126 incorporating a preferred nailing head of the present invention. The device of Colson employs three prior art nailing units, one for each stringer positioned in a machine direction as indicated by arrow 42 as shown in FIG. 1. Each nailing unit 126 of the present invention is mounted to the vertical support structure of the nailing station (shown in FIG. 1).

The nail driving assembly of the present invention is a portion of a nailing station. When used in an automatic nailing device which includes more than one nail driving assembly in the nailing station, a plurality of substantially identical nail driving assemblies are used and therefor only one will be described in detail.

The nail driving assembly 126 of the present invention includes a flat metal plate 128 which is secured to the frame of the nailing station (not shown) by means of fastening to upper horizontal support beams 130, 132 and lower horizontal support beams 134, 136. An uppermost portion of the plate 128 is also fastened to an upper I-beam 138 which is part of the support frame of the nailing station.

The nail driving assembly 126 includes a vertically mounted hydraulic cylinder 140. The cylinder 140 has a ram 142 which extends downwardly in response to fluid pressure in an upper portion of the barrel, and upwardly in response to fluid pressure in a lower portion of the barrel. The ram 142 is coupled to a driving rod 144 which extends into a nailing head 146.

An actuator 148 is provided for causing a picker plate 150 to move horizontally back and forth in reciprocal motion in a direction shown by arrow 152 and in an opposite direction. The driving rod 144 includes an enlarged section 154 which has a lower shoulder 156 for contacting an upper surface 158 of the actuator 148 when the driving rod 144 is near the end of its downstroke. The features and operation of the actuator 148 will be described in more detail below.

The nail driving assembly 126 includes a novel nailing head 146 which advantageously delivers nails at greater rates of speed greater and with reliability than known devices. The features and operation of the nailing head 146 of the preferred embodiment will be described in more detail below.

The nail driving assembly 126 is positioned above the objects to be nailed 160 located beneath a terminal end of the nailing head 146. A support structure 162 supports the objects to be nailed 160 during the nailing operation.

Figure 5:
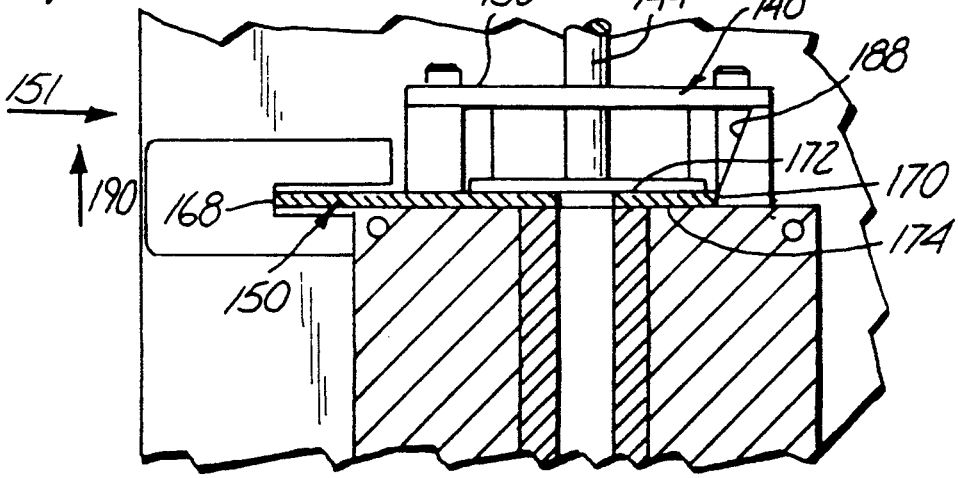
FIG. 5 is an enlarged cross-sectional view of an upper end of the actuator and the nail picker plate of the preferred embodiment taken along line 4—4 as shown in FIG. 4.
Figure 6:
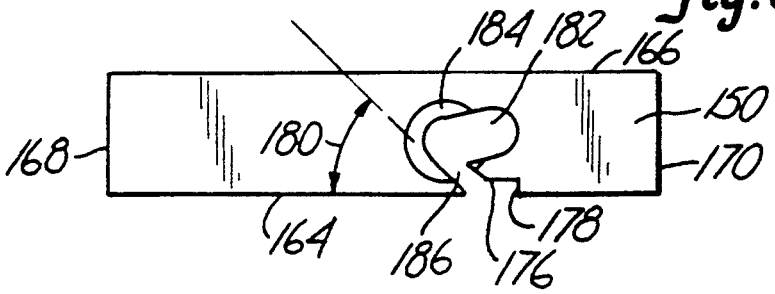
FIG. 6 is a top plan view of the nail picker plate of the present invention.

Referring to FIGS. 5 and 6, FIG. 5 shows the nail picker plate 150 and an upper portion of the actuator 148 in cross-section taken along line 4—4 in FIG. 4. FIG. 6 is a top plan view of the nail picker plate of a preferred embodiment. Located beneath an upper surface 158 of the actuator 148 is a nail picker plate 150. The nail picker plate 150 is mounted for sliding engagement in the nailing head 146. In operation, the nail picker plate 150 moves in a direction shown by arrow 151 and in a direction opposite the direction shown by arrow 151.

The nail picker plate has a front edge 164, an opposite rear edge 166, a side edge 168 and a cammed opposite edge 170. The nail picker plate 150 also has a first major surface 172 and an opposite major surface 174. Extending through the first front edge 164, and the first and opposite major surfaces 172 and 174 is a notch 176 which in the preferred embodiment has a side edge 178 nearest the cammed edge 170 which is at approximately right angles with the front edge 164. The notch 176 has an edge opposite the side edge 178 which forms an acute angle 180 with the front edge 164.

The nail picker plate 150 has an aperture 182 which in the preferred embodiment is substantially elliptical and extends through the first and opposite major surfaces 172 and 174. Preferably, the aperture 182 has a beveled upper edge 184 which is substantially frustaconical in shape. The aperture 182 is of a size and shape sufficient to accept a nail and to permit a nail head to drop through the aperture 182.

Extending between the aperture 182 and the notch 176 is a channel 186. The channel permits nails retained in the notch 176 to move into the aperture 182 while the picker plate 150 moves into a second position which is in a direction shown by arrow 151.

The actuator 148 includes a camming surface 188 which is disposed at an angle identical to camming surface 170 with respect to the horizontal. Camming surface 188 is provided to cause the picker plate 150 to move in a direction shown by arrow 151 as the actuator 148 moves in a direction opposite shown by arrow 190 (downwardly). Conversely, when the actuator 148 moves upwardly in a direction shown by arrow 190, then the picker plate 150 moves in the direction opposite of what is shown by arrow 151.

Referring to FIGS. 7 and 8, FIG. 7 is a top plan view showing the nail picker plate and actuator mounted into the nailing assembly. FIG. 8 is a cross-sectional view of the actuator 148 taken generally along line 7—7 as shown in FIG. 7. The actuator is mounted onto a flat plate 192 which is mounted onto the frame 190. The actuator includes a movable portion 194 and a stationary portion 196. Within the stationary portion 196 are two spaced apart cavities 198, 199 sized to receive a spring 200, 201. Each spring provides an upward force on legs 202, 204 of the movable portion 194. Each leg 202, 204 has an enlarged lower end 206, 208 which engages a shoulder 210, 212 in the cavities 198, 199. The shoulders 210, 212 prevent the movable portion 194 of the actuator from being released from the stationary portion 196.

The driving rod 144 has a shoulder 156 on a enlarged section 154 near the coupling positioned between the ram 142 and the driving rod 144 (shown in FIG. 4). The shoulder 156 contacts an upper surface 158 of the actuator when the driving rod 144 nears the bottom of the downstroke, causing the upper surface 158 of the actuator 148 to move downwardly. When the driving rod 144 reaches the bottom of a stroke and changes directions, the upper surface 158 of the actuator 148 moves upwardly.

Figure 3:
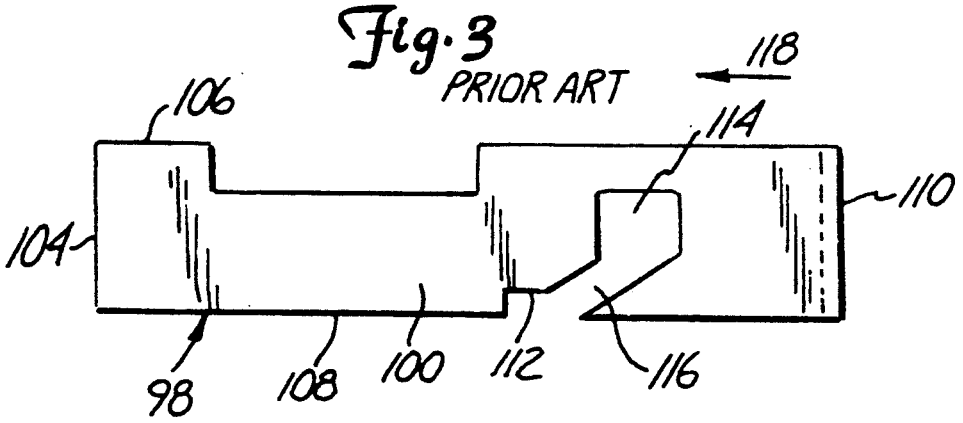
Fig. 3 PRIOR ART
FIG. 3 is an enlarged top plan view of a prior art picker plate.

A plurality of nails 214 are fed from a nail pan (not shown) down a nail track 216 which in the preferred embodiment vibrates during operation. When the driving rod 144 is in a retracted upper position, and as the driving rod moves downwardly, but prior to when the shoulder 156 contacts an upper surface 158 of the actuator, and when the driving rod moves upwardly, but after the shoulder 156 is no longer in contact with the upper surface 158, the nail picker plate 150 is in a first position. In the first position, as shown in FIG. 7, the notch 176 is aligned with an opening in the nail track 216 so that a nail can position itself in the notch 176. Since during the majority of the stroke of the driving rod 144 the nail picker plate 150 is in the first position, there is ample time for the nail to position itself in the notch 176 with the aid of vibration. This feature advantageously improves the reliability of the nailing head because a nail virtually always becomes loaded into the notch 176 during each cycle of the driving rod 144. The notch 112 of the known nail picker plate (shown in FIG. 3) in contrast does not accept a nail when in the first position.

As the shoulder 156 makes contact with the upper surface 158 during a downstroke, the upper surface 158 begins to travel downwardly. A spring biasing device 218 is provided to drive the nail picker plate 150 into a second position (not shown). The spring biasing device 218 includes a housing 220, a cavity 222 within the housing, and a spring 224 located within the cavity 222. The spring 224 exerts a force against edge 168 of the nail picker plate 150 which biases the cammed surface 170 against the cammed surface 188 of the actuator 148. As the picker plate 150 moves into the second position, the nail is forced against a side opposite the side edge 178 of the notch 176 which is disposed at an acute angle 180 with respect to the front edge 164 (shown in FIG. 6) causing the nail 214 to move into the channel 186. The channel is wider than the shank of the nail 214 but is more narrow than the nail head so that the nail remains suspended while moving toward the aperture 182. The momentum of the nail 214 and picker plate 150 causes the nail to move into the aperture 182 where the nail head is released and is dropped through the aperture 182 into a nail receiving passage located beneath the plate 150. The upper beveled surface 184 aids in centering the nail 214 in the aperture 182.

Figure 9:
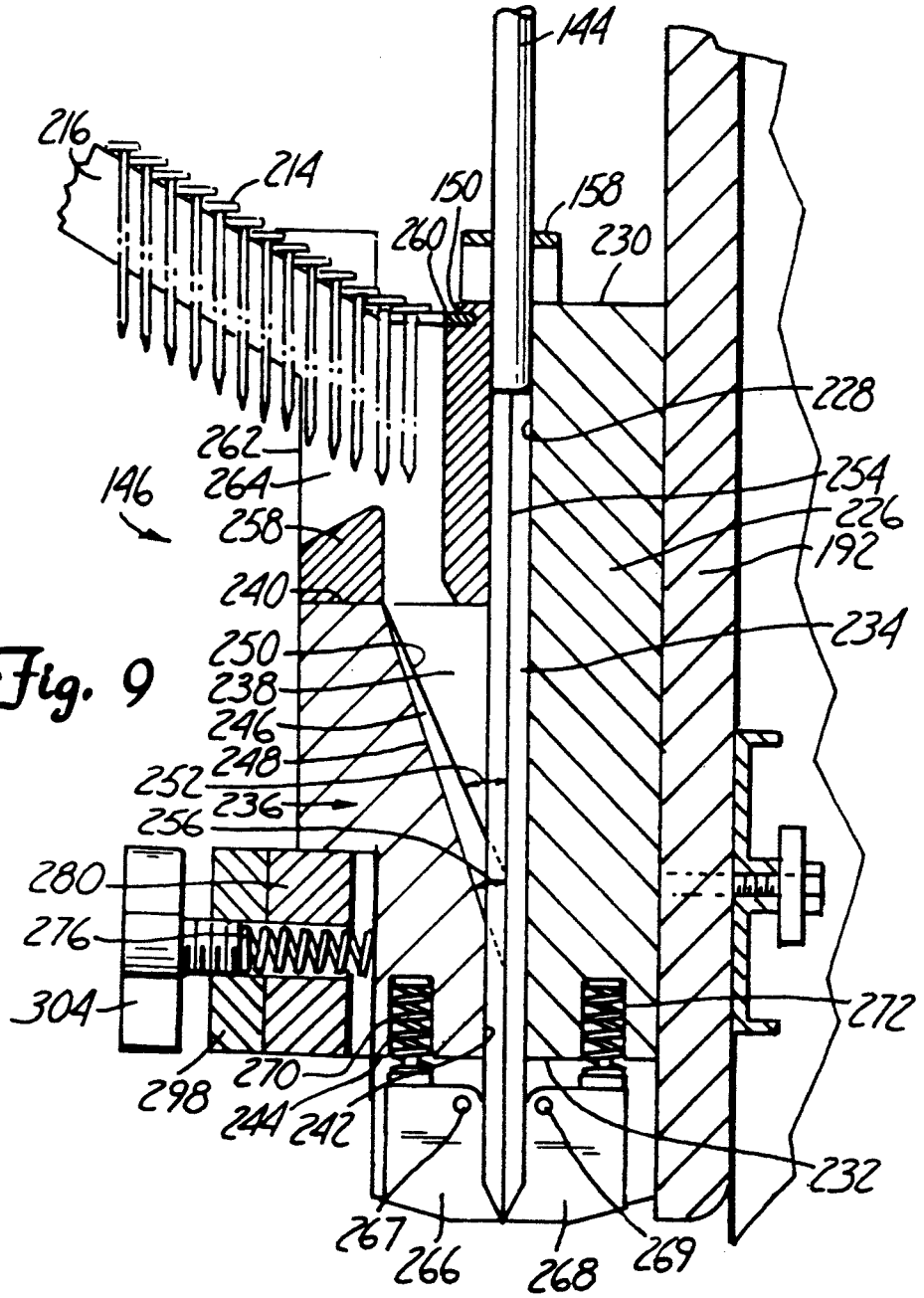
FIG. 9 is an enlarged cross-sectional view of the nailing head of the preferred embodiment of the present invention.

Referring now to FIG. 9, a detailed cross-sectional view of the preferred nailing head 146 taken generally along line 4—4 as shown in FIG. 4 is shown. The nailing head 146 includes a chuck back 226 having a longitudinal groove 228 from an upper end 230 to a lower end 232 which is concave and which forms a portion of the longitudinal throughbore 234. In the preferred embodiment, the longitudinal throughbore 234 is substantially cylindrical in shape.

A chuck front 236 is provided which has a declining nail feeding channel 238 extending downwardly from an upper end 240. The chuck front 238 also has a longitudinal groove 242 extending from a point near a midpoint of the chuck front 236 to a lower end 244. The groove 242 is concave and mates with the concave longitudinal groove 228 of the chuck back 226 forming a cylindrical throughbore 234. The nail feeding channel 238 intersects the throughbore 234 at a point approximately two thirds the distance from the upper end 240 to the lower end 244.

The nail feeding channel 238 advantageously includes a means for gradually reducing an angle defined by the intersection of a central axis of the nail shank (not shown) and a central axis 254 of the throughbore as the nail moves from the nail feeding channel 238 into the longitudinal throughbore 234. The preferred means includes a substantially rectangular groove 246 cut into a lower surface of the nail feeding channel 238 having a lower surface 248 which is substantially flat and rectangular in shape. The groove 246 is wide enough to accept the shank of the nail 214 but is narrow enough that the nail head remains above a top edge 250 of the groove 246. An angle 252 between the a reference plane containing the edge 250 and a centerline of the throughbore 254 in the preferred embodiment is between about 20 and about 30 degrees and is preferably about 25 degrees. An angle 256 between a reference plane containing the lower surface 248 of the groove 246 and a centerline 254 of the throughbore 234 is between about 18 and about 22 degrees with a preferred angle of about 18 degrees. In all cases, angle 256 should be at least a few degrees smaller than angle 252.

The groove 246 advantageously permits the nail to gradually change direction from an angle of approach 252 to the vertical. The gradual change in direction of the nail 214 permits the nails to decline at a faster rate of speed than when the nails change direction proximate the intersection of the nail feed channel and the throughbore.

The nail head 146 also includes an upper front chuck portion 258 having an upper surface 260 for receiving a lower surface 174 of the nail picker plate 150. A longitudinal opening 262 is provided for receiving the vertically oriented nails 214. A vertical cavity 264 is provided which feeds the nails into the nail feeding channel 238 of the chuck front 236.

Mounted onto a lower end 232 of the chuck back 226 and mounted onto a lower end 244 of the chuck front 236 are a pair of jaw members 266, 268. Jaw members 266 and 268 are mounted by pivot pins 267, 269 into respective apertures in lower portions of the chuck front 236 and the chuck back 226. The jaw members 266, 268 are spring biased by means of springs 270, 272 in a closed position. The spring tension is sufficient to hold the jaw members 266, 268 together until the driving rod 144 drives a nail positioned just above the jaw members 266, 268 (not shown) through the jaw members 266, 268 and into objects to be nailed located beneath the lowermost portion of the jaw members 266, 268.

Figure 10:
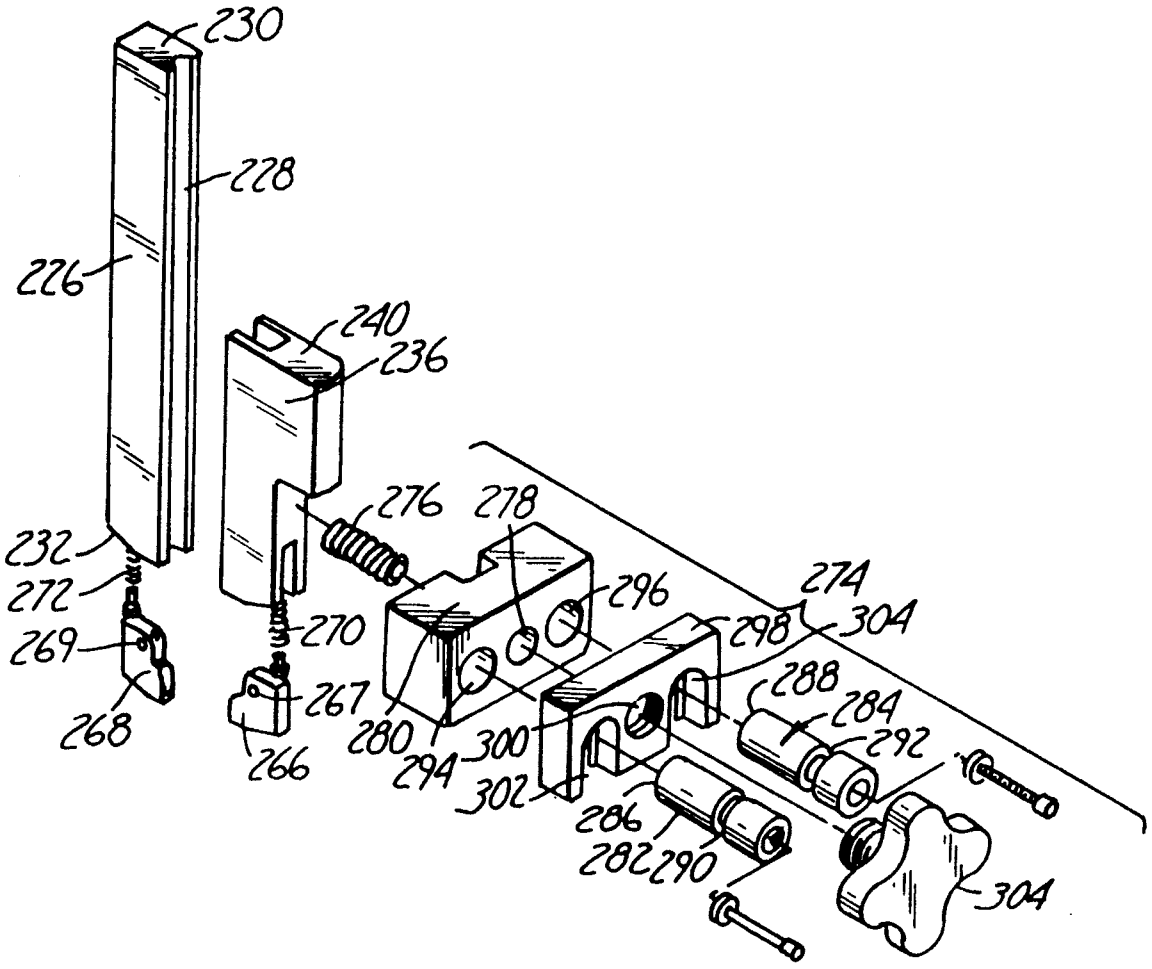
FIG. 10 is an exploded perspective view of the nailing head of the present invention showing a quick release mechanism.

Because of the amount of shock imparted on the chuck back 226 and chuck front 236 during operation, the components are clamped together by means of spring loading as shown in FIG. 10. In addition, nails sometimes become jammed in the nail feeding channel 238 and the throughbore 234. To address both problems, the nailing head 146 is resiliently mounted onto the vertical plate 192 (shown of FIG. 4) by means of a quick release assembly 274.

A spring 276 is provided for insertion into an aperture 278 in a chuck holder 280. A pair of chuck holder slides 282, 284 are fixedly mounted at first ends 286, 288 to a support structure (not shown) which straddles either side of the chuck back 226 and is bolted to the back plate 192 (shown in FIG. 9). Each slide 282, 284 has an inwardly extending circumferencial groove 290, 292 located spaced from an end opposite the first end 286, 288.

The chuck holder 280 has two apertures 294, 296 positioned on either side of the spring aperture 278 for receiving the slides 282, 284. A chuck holder clamp 298 is provided having a central threaded aperture 300 and slots 302, 304 having inner surfaces with outwardly extending shoulders located on either side of aperture 300. The shoulders of the slots 302, 304 are sized to fit snugly within the grooves 290, 292 of the slides 282, 284. To assemble the nailing head, the chuck back 226 and chuck front 236 are placed between the outwardly extending slides 282, 284. The chuck holder 80 is placed against the chuck front 236 and the spring 276 is inserted into the aperture. The clamp 298 is forced against the spring until the clamp 298 is placed over the slides to lock the assembly together. Since the threaded aperture 300 of the clamp 298 is smaller than the diameter of the spring 276, the clamp 298 when in place spring loads the device. A chuck holder knob 304 is provided to adjust tension on the spring. The knob 304 has an outwardly extending male threaded end which mates to the threaded aperture 300 in the clamp 298. The outwardly extending male threaded end exerts force against an end of the spring 276, causing the spring 276 to apply more or less tension on the assembly, as needed.

The quick release mechanism described above allows the operator to remove any jammed nails in a matter of minutes, as compared to spending ten to twenty minutes per occurrence with devices lacking the quick release feature.

In operation, a nail is dropped as the driving rod 144 nears the bottom of its downstroke. The dropped nail is in a position to be nailed as the driving rod 144 rises above a point of intersection of the nail feed channel 138 and the throughbore 234. After the picker plate picks the next nail and moves from the first to the second position, as the driving rod 144 nears the bottom of its downward stroke, the nail which is in position is driven, and the next nail is dropped as the driving rod 144 begins its upward stroke.

The device of Colson is capable of consistently manufacturing 5 pallets per minute. The improvements described above have permitted time gains of as much as two seconds per pallet, which equates to a 3.5% increase in production rate.

Although the present invention has been described with reference to preferred embodiments, workers skilled in the art will recognize that changes may be made in form and detail without departing from the spirit and scope of the invention.

What is claimed is:

1. An nail driving assembly for an automatic nailing device, comprising:

a support frame;

a hydraulic cylinder with a ram mounted on the support frame;

a nailing rod mounted to the ram for driving nails;

control means for controlling the movement of the nailing rod and ram;

a nailing head comprising:

a main body portion having a longitudinal throughbore extending therethrough defining first and second openings, the throughbore for receiving a nail and the nailing rod;

a nail feed channel extending from a third opening in the main body and intersecting the longitudinal throughbore;

a nail picker plate mounted for sliding engagement in the main body portion proximate the third opening having first and second major surfaces and an aperture extending therethrough, an edge with a receiving notch extending into the edge, and a channel connecting the aperture and the receiving notch;

actuation means for causing the nail picker plate to move back and forth from a first position to a second position and for causing a nail to be positioned in the notch when the plate is in the first position, and to move from the notch, through the channel, into the aperture and down into the nail delivery channel when the plate is in the second position, said picker plate movable from the first position to the second position as the nailing rod moves downwardly; and means for retaining a nail in the longitudinal throughbore until the driving rod drives the nail out of the throughbore.

2. The device of claim 1 wherein the aperture of the nail picker plate has a tapered inner surface between the first and second major surfaces, wherein an opening in the major surface which first receives a nail is larger than the opening in the second major surface.

3. The device of claim 1 and further comprising a means for applying a bias to the nail picker plate such that the plate remains in a first position except when the nailing rod is near a lowest portion of the stroke.

4. The device of claim 1, wherein the actuation means comprises a tapered inner surface and spring means for biasing the picker plate into said second position when the driving rod is near a lowest portion of the stroke.

* * * * *

UNITED STATES PATENT AND TRADEMARK OFFICE

CERTIFICATE OF CORRECTION

PATENT NO. : 5,316,200

DATED : May 31, 1994

INVENTOR(S) : ROGER W. WALLIN

It is certified that error appears in the above-identified patent and that said Letters Patent is hereby corrected as shown below:

Col. 5, line 35, before "reliability", insert --better--

Col. 7, line 36, delete "chuck front 238", insert --chuck front 236--

Signed and Sealed this

Twenty-third Day of August, 1994

*Attest:*

*Attesting Officer*

BRUCE LEHMAN

*Commissioner of Patents and Trademarks*